US006742344B2

(12) United States Patent
Vormedal

(10) Patent No.: US 6,742,344 B2
(45) Date of Patent: Jun. 1, 2004

(54) SHELVED CUPBOARD FOR REFRIGERATED GOODS AND METHOD OF CONTROLLED/REGULATED CIRCULATION OF AIR IN THE SHELVED CUPBOARD

(76) Inventor: Svein Henrik Vormedal, Tordenskjoldsg. 14, Stavanger (NO), N-4009

( * ) Notice: Subject to any disclaimer, the term of this patent is extended or adjusted under 35 U.S.C. 154(b) by 0 days.

(21) Appl. No.: 10/312,541

(22) PCT Filed: Jun. 21, 2001

(86) PCT No.: PCT/NO01/00261

§ 371 (c)(1),
(2), (4) Date: Dec. 26, 2002

(87) PCT Pub. No.: WO02/05689

PCT Pub. Date: Jan. 24, 2002

(65) Prior Publication Data

US 2003/0172670 A1 Sep. 18, 2003

(30) Foreign Application Priority Data

Jun. 26, 2000 (NO) ..... 003327
May 10, 2001 (NO) ..... 012296

(51) Int. Cl.[7] ..... A47F 3/04
(52) U.S. Cl. ..... 62/89; 62/256; 454/193
(58) Field of Search ..... 62/255, 256, 413, 62/414, 89; 454/193

(56) References Cited

U.S. PATENT DOCUMENTS 3,063,256 A 11/1962 Lamb
3,115,019 A 12/1963 Rutishauser
3,139,738 A 7/1964 Jarvis
3,168,818 A * 2/1965 Weber ..... 62/256
3,218,822 A * 11/1965 Bently et al. ..... 62/256
3,289,432 A * 12/1966 Brennan et al. ..... 62/256
4,389,852 A 6/1983 Abraham
4,760,708 A * 8/1988 Karashima ..... 62/256

FOREIGN PATENT DOCUMENTS

| | | |
|---|---|---|
| DE | 1 501 247 | 1/1970 |
| EP | 589783 | 3/1994 |
| FR | 2690825 | 11/1993 |
| GB | 2198220 | 6/1988 |

* cited by examiner

*Primary Examiner*—William E. Tapolcai
(74) *Attorney, Agent, or Firm*—Andrus, Sceales, Starke & Sawall, LLP

(57) ABSTRACT

A shelved cupboard for refrigerated goods comprises an opening (1) for putting in or taking out refrigerated goods (2) and a ducting arrangement (3–10) for circulating of cooled air form a cooling element (11) provided thereto. The ducting arrangement (3–10) enables cooled air to be carried in separate streams, partly in between the refrigerated goods (2) and partly past the opening (1) in order to create a screening layer. The distribution of cooled air between the refrigerated goods (2) takes place via an outlet nozzle (7) at an end of an overlying shelf (12), while the distribution of cooled air to the screening layer takes place via an outlet nozzle (10) near the upper transverse end of the opening (1). The creation of the screening layer is brought about by means of cooled air that has first been led in between the refrigerated goods (2), in order then to become somewhat less cooled than cooled air directly from the cooling element (11), whereupon such less cooled air is drawn into a ducting section (8) through perforations (13) in the back wall (12) of the goods compartment, and then passed form the perforated ducting section (8) through an upper ducting section (9) and finally distributed via the outlet nozzle (10) near the opening (1).

23 Claims, 7 Drawing Sheets

SHELVED CUPBOARD FOR REFRIGERATED GOODS AND METHOD OF CONTROLLED/REGULATED CIRCULATION OF AIR IN THE SHELVED CUPBOARD

CROSS REFERENCE TO RELATED APPLICATION

The present application is the U.S. national stage application of International Application PCT/NO01/0261, filed Jun. 21, 2001, which international application was published on Jan. 24, 2002 as International Publication WO 02/05689. The International Application claims priority of Norwegian Patent Application 2003327, filed Jun. 26, 2000 and Norwegian Patent Application 20012296, filed May 10, 2001.

SUMMARY OF THE INVENTION

The present invention regards a shelved cupboard for refrigerated goods, comprising an opening for putting in or removing refrigerated goods and an arrangement of ducts for circulation of cooled air from an associated cooling element, such as an evaporation battery, and which in other respects is also designed and constructed in accordance with the introductory part of claim 1. The air that is circulated in the ducting system and the interior of the cupboard, as well as between the refrigerated goods, may be cooled to a greater or lesser degree (primary and secondary air). Primary air is the colder of the two and is led to immediate contact with the most exposed part of the refrigerated goods, directly—via the cupboard shelves and, thereupon—via the interior of the cupboard to the front of the cupboard forming a screen, to reduce the penetration of room air, thus indirectly cooling the refrigerated goods.

The invention also regards a method of regulated/controlled circulation of air in a shelved cupboard of the type in question, which method is in accordance with claim 18.

The ducting arrangement is designed so as to let cooled air be carried in separated streams, first in between the refrigerated goods; and then past the front opening in order to form a screening layer inside this, so as to keep the temperature of the refrigerated goods at a desired level and prevent indoor air from entering the shelved cupboard through the opening. The cooled (primary) air that is to be led in between the refrigerated goods on the shelf, is distributed via at least one outlet nozzle provided near the outer edge of an overlying shelf, and somewhat less cold air (secondary air) that is to be led past the opening is distributed via at least one outlet nozzle provided near the upper front edge of the opening.

A main problem associated with shelved cupboards for refrigerated goods is to avoid necessary removal of frost and ice, that will always form on the associated cooling element, from causing undesirable warming of the refrigerated goods in the shelved cupboard. In previously known shelved cupboards, the indoor air is, as shown in DE 1 501 247, generally prevented from entering by a screening layer of cooled air that is formed inside the opening of the shelved cupboard. However the required removal of frost and ice on the cooling element is carried out in various manners, e.g. by direct passage of warm indoor air in the ducting arrangement as shown in U.S. Pat. No. 4,389,852.

A stable and sufficient supply of cooled air to be past the opening in order to form the screening layer, together with a sufficiently low temperature of the cooled air to be carried in between the refrigerated goods, constitutes the criterion for efficient operation of the shelved cupboard. As aqueous refrigerated goods that contain a certain amount of salt, sugar or other additives normally freeze at −1° C., the temperature of the goods is normally kept at between −1° C. and +4° C., thereby to prevent the refrigerated goods from sustaining frost damage or freezing to the shelves. Another fact that imposes limitations on the acceptable temperature of the primary air from the cooling element is that the amount of frost and ice formed on the cooling element will increase as the temperature decreases. Furthermore, the amount of frost and ice formed on the cooling element will always vary with the temperature and humidity of the air outside the shelved cupboard. A particular disadvantage of having frost and ice forming on the cooling element is that the amount of cooled air given off by the commonly used cooling elements will taper off to nothing as the volume of frost and ice on the cooling element grows and blocks the air passages. As such, a stable and sufficient volume of air to the screening layer will not be available.

U.S. Pat. No. 3,168,818 describes a shelved cupboard for refrigerated goods, in which the shelves are shaped so as to be hollow with open ends, and are connected to a vertically disposed duct for downward flow of cold air. A disadvantage of this known refrigerator with an uncovered opening is that warmer indoor air can easily enter the interior of the cupboard and get into contact with the refrigerated goods via the uncovered cupboard opening.

BRIEF DESCRIPTION OF THE INVENTION

The main objective of the present invention is to provide an improved shelved cupboard for refrigerated goods, of the type described by way of introduction. This is realised in the manner that appears from the characteristion of the claims.

The method according to the invention is distinguished through the combination of operational steps stated in the claims.

An important feature of the invention consists in the reuse of the primary air as secondary air without additional use of energy to cool it. Towards the end of one cycle the secondary air is to be led past the opening in order to form the screening layer (air curtain), after it first has passed in between the refrigerated goods in the form of primary air, in order to cool and thereby absorb heat from these, whereupon such, now less cold air is drawn into a ducting section through at least one perforation in the back wall of the refrigerated goods compartment, and then passed from the perforated ducting section through an upper ducting section and finally distributed via the outlet nozzle(s) near the opening. This allows cooled air from the cooling element to be used in a far more efficient manner, first to envelop and directly cool the refrigerated goods, and then (in a less colder condition, such as secondary air) to form the screening layer inside the opening of the shelved cupboard. The ducting arrangement may also be used when removing frost and ice from the cooling element, i.e. for defrosting, in a manner that prevents any significant amount of warm indoor air from being induced into the refrigerated goods. Using two fans connected directly in series will ensure a sufficient quantity of air to the screening layer at defrosting.

The shelved cupboard may be provided with a third adjustable fan for creating a separate outer layer of indoor air outside of the screening layer. Provided the fan for indoor air is adjusted so as allow both layers to flow in a laminar fashion relative to each other, the presence of the outer layer of indoor air outside the screening layer will reduce the entry of indoor air through the opening in an economical way both during normal cooling operation and during defrosting.

A ducting section for supply of cooled air from the cooling element to the outlet nozzle(s) in the shelf in question through a ducting section arranged in the shelf may, by means of a rotatable damper, be connected directly to the upper ducting section with the outlet nozzle(s) near the opening. When the damper is rotated to a position for closing off the perforated ducting section and the cooling element is not active, the air will circulate in selected ducting sections during defrosting of the cooling element. Thus the defrosting of the cooling element can be controlled in a far more efficient manner than in previously known shelved cupboards. One of several advantages of using such a rotatable damper in the ducting arrangement is that the refrigerated goods will not be exposed to warm air through the nozzles in the shelf/shelves during defrosting.

The upper ducting section, which during normal operation connects the perforated ducting section with the outlet nozzle(s) near the opening, is provided with a fan for drawing secondary air into the perforated ducting section and then feeding it through the various ducting sections for distribution to create the screening layer via the outlet nozzle(s) near the opening. In addition, a lower ducting section connected to the ducting section for feeding primary air from the cooling element through the ducting section in the shelf in question to the outlet nozzle(s) near the end of the shelf, is provided with a fan. This entails the fans in the shelved cupboard being connected directly in series during the defrosting, thus giving a shorter defrosting time due to the increased circulation rate in the ducting section.

In order to avoid the refrigerated goods being frost damaged or freezing to the cold shelves containing primary air ducts, each shelf may be provided with a spacer that keeps the refrigerated goods at a suitable distance above the shelf body.

Measures may be taken on the outside of the air curtain that acts to screen the opening and thereby prevent entry of indoor air into the inner cavity of the shelved cupboard, which measures are intended to establish and later maintain a second air curtain immediately outside the cupboard opening. This is brought about by forming a duct outside the cupboard, in front of its front wall, above the perimeter of said opening. This duct runs indoor air, so that the outer air curtain in front of the opening will be at a higher temperature than the secondary air flowing in the ducting system.

By an embodiment of the shelved cupboard that is distinguished by simple manufacture, cooled air (primary air) is introduced into a first upward ducting section, which air is drawn through a cooling element via a fan in a lower horizontal ducting section. This first ducting section communicates with the interior cavity of the shelved cupboard via through cavities in the hollow shelves, the interior cavity being filled with cooled air that has absorbed some of the thermal energy of the refrigerated goods on shelves and thus should be considered secondary air. Via through pipes/ports that extend in a sealing manner through the vertical walls defining the first ducting section, the interior cavity of the shelved cupboard in front of and between the shelves is in fluid communication with a second ducting section for secondary air, located in parallel with and to the rear of the first ducting section. At the top, this second, rear upward ducting section passes into a horizontal, forward (directed towards the cupboard opening) ducting section equipped with a fan. The outlet nozzle is formed by the outermost end of this horizontal ducting section, retracted slightly from the face of those wall portions defining the cupboard opening from above, below and from the sides.

BRIEF DESCRIPTION OF THE DRAWING

The present invention will now be explained in greater detail by means of a preferred embodiment shown in the appended drawings, in which.

DETAILED DESCRIPTION OF THE INVENTION

Figure 1:
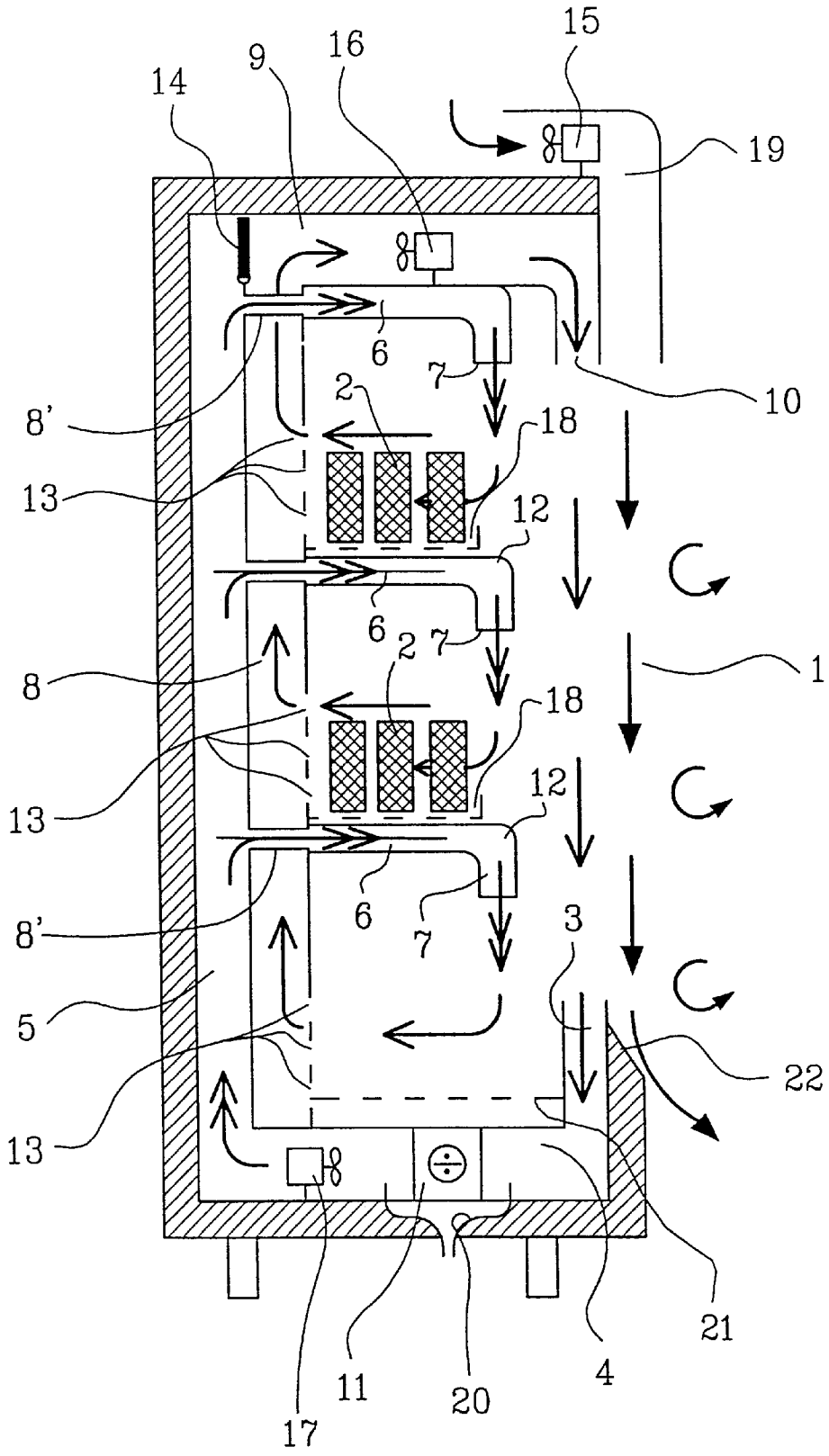
FIG. 1 shows a schematic vertical section through a shelved cupboard comprising a front opening for putting in or taking out refrigerated goods, and a ducting arrangement designed so as to allow cooled primary air from an ancillary cooling element to be passed first in between the refrigerated goods via an outlet nozzle by the front end of an overlying shelf, thereby to absorb heat from the goods, whereupon such now less cool secondary air is drawn into a ducting section having perforations, is passed from this and distributed for creation of the screening layer via the outlet nozzle by the opening.
Figure 2:
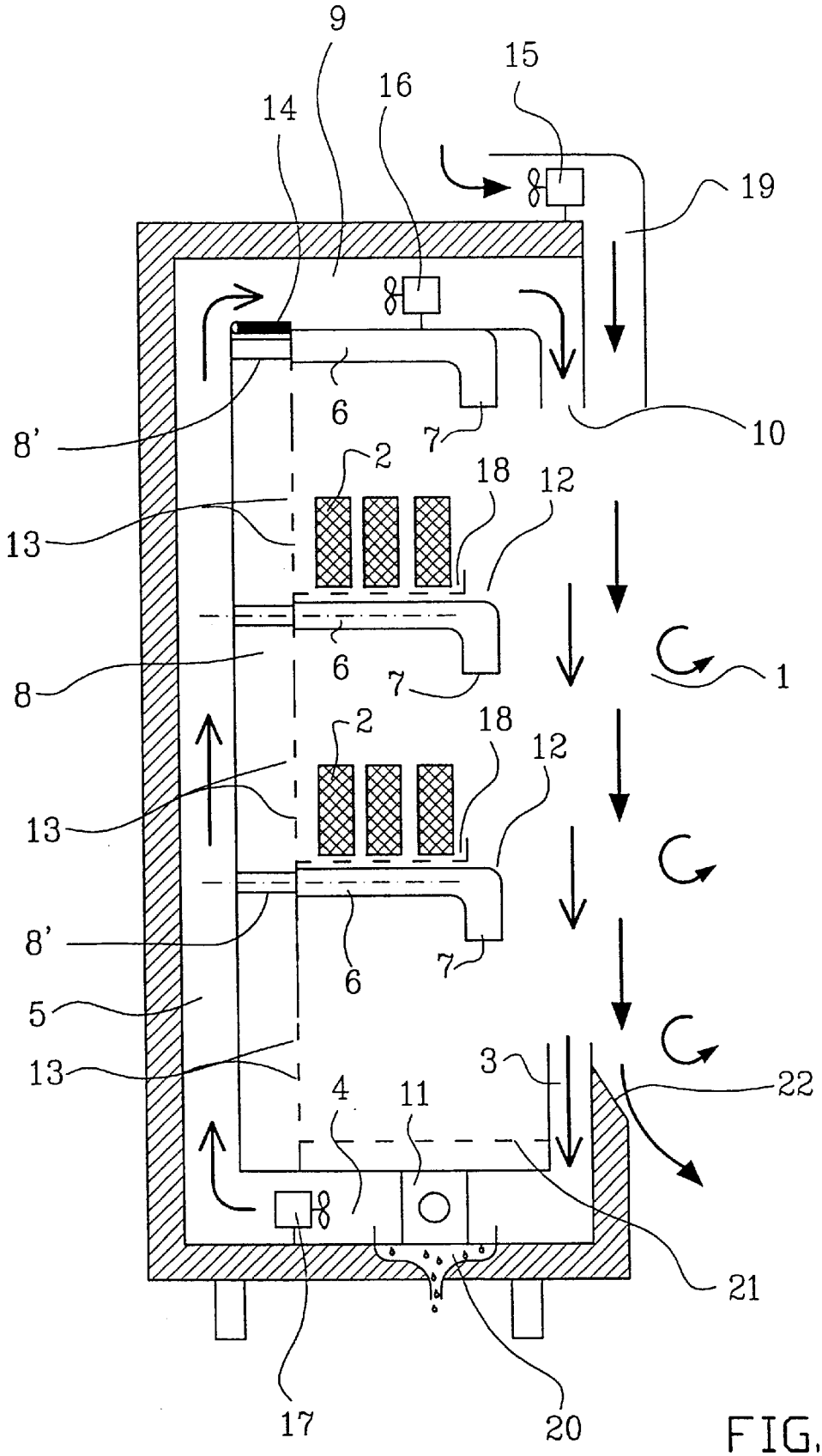
FIG. 2 shows a vertical section similar to that of FIG. 1, apart from the fact that the cooling element is being defrosted with the cooling process shut down, where a rotatable damper provided by the upper end of a ducting section for feeding of cooled primary air from the cooling element to the outlet nozzle in the shelf in question through a ducting section provided in the shelf, has been rotated to a position in which it closes off the perforated ducting section and connects the first-mentioned ducting section to an upper ducting section connected to the outlet nozzle near the opening, so that air which is now not actively being cooled may circulate in selected portions of the ducting arrangement during the defrosting and maintain a screening layer.
Figure 3:
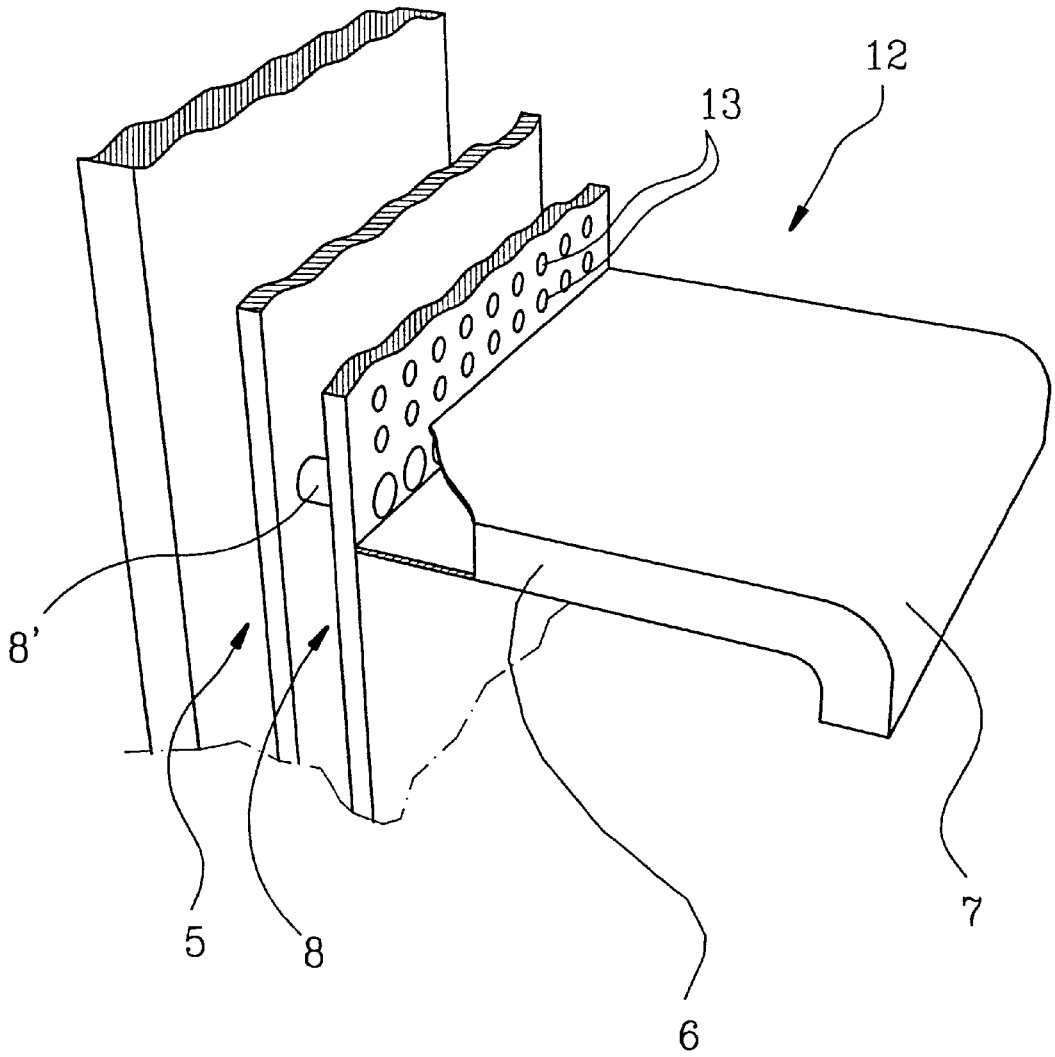
FIG. 3 shows an enlarged perspective part drawing in which small corner portions have been cut away in order to illustrate the internal structure.

Reference is first made to FIGS. 1 to 3, which show said first embodiment of the invention.

The present shelved cupboard has four vertical wall sections and two horizontal end sections, an opening 1 for putting in or taking out refrigerated goods 2, as well as a number of shelves 12 and a lower, basket-like shelf 21 for placing refrigerated goods in the shelved cupboard. The wall and end sections are normally provided with a suitable insulating material. Beyond that, it will be appreciated that the shelved cupboard is not limited to the rectangular cross-section shown, as any other expedient cross-section and dimension may be selected for all the principal directions of the shelved cupboard.

Cooled air that is to circulate in the shelved cupboard is delivered from a cooling element 11, e.g. an evaporation battery, positioned in a lower ducting section 4. The cooling element 11 is provided with a drain 20 to allow condensation water to be passed out through the lower end section of the shelved cupboard.

The shelves 12 for storing the refrigerated goods 2 are equipped with a spacer 18 that keeps the refrigerated goods at a suitable distance above the shelf. The spacer 18 has a front stop edge that extends upwards so as to prevent the refrigerated goods from falling off the shelf 12 even when the shelf 12 slopes downwards. Use may for instance be made of special distance pieces (not shown) that keep the spacer 18 at a distance from the shelf 12, and the spacer 18 may be made from a suitable insulating material. In addition, the spacer 18 may be provided with perforations (not shown). This enables cooled air that has been led into the gap between the shelf 12 and the spacer 18 to flow further up between the refrigerated goods 2, thereby to enhance the cooling effect.

The shelved cupboard comprises a ducting arrangement 3–10 for circulating cooled air from the cooling element 11 in separate streams, partly in between the refrigerated goods 2; partly past the opening 1 for formation of a screening layer inside the opening. Cooled air that is to be led in between the refrigerated goods 2 located on the shelves 12 is supplied from the cooling element 11 through a ducting section 5 connected to the lower ducting section 4 with the cooling element 11, from there through associated ducting sections 6 provided in separate overlying shelves 12, further to at least one outlet nozzle 7 near the end of the shelf facing the opening 1. Cooled air that is to be sent past the opening 1 is supplied from a ducting section 8 with at least one perforation 13 above the shelves 12 in question, from there through an upper ducting section 9 connected to the perforated ducting section 8, to at least one outlet nozzle 10 near the upper transverse end of the opening 1. The lower ducting section 4 with the cooling element 11 is provided with a separate ducting section 3 that faces upwards by the lower transverse end of the opening 1 and is designed to catch cooled air from the screening layer.

As shown in FIG. 1, cooled air for creating the screening layer inside the opening is first passed in between the refrigerated goods 2, so that the temperature will rise slightly relative to the temperature of cooled air directly from the cooling element 11, whereupon such less cold secondary air is drawn into the perforated ducting section 8 via the perforations 13, through the associated upper ducting section 9, and is finally distributed via the outlet nozzle 10 near the opening.

Preferably, the lower ducting section 4 with the cooling element 11, the vertical ducting sections 5, 8 and the upper ducting section 9 are formed by means of separate dividing elements that extend horizontally or vertically between opposite side walls of the shelved cupboard. In addition, some or all of said ducting sections may be provided with one or more transverse dividing elements (not shown), so that the ducting sections are divided into several passages or end up with a smaller width than the actual shelved cupboard. The ducting sections 6 through the shelves 12 may either be constituted by a single, or be divided into several separate passages. Communication between the ducting section 5 and the ducting sections 6 in the shelves 12 may for instance be effected by means of at least one piece of piping 8' that extends through the perforated ducting section 8.

Drawing less cooled secondary air into the perforated ducting section 8 and subsequently leading it from there to the outlet nozzle 10 near the opening 1 takes place by means of a fan 16 positioned in the upper ducting section 9. Supply of cooled primary air from the cooling element 11 to the outlet nozzles 7 near the end of the shelves takes place by means of a fan 17 positioned in the lower ducting section 4 downstream of the cooling element 11.

In order to form a separate layer of indoor air to cover the opening 1 outside of the screening layer, the shelved cupboard is provided with an adjustable fan 15 for indoor air, which is placed above the upper transverse end of the opening 1. The fan 15 is associated with a ducting section 19 that effects an even distribution of the layer of indoor air across the opening 1. The lower transverse edge of the opening is in the form of a bevel 22, the lower part of which will deflect the layer of indoor air outwards from the shelved cupboard. The operation of the fan 15 for indoor air can, e.g. through two-speed operation, be matched to the operation of the fans 16, 17 inside the shelved cupboard, so as to let the respective layers flow in a laminar fashion relative to each other.

Beyond that, the ducting section 5 for supply of cooled air from the cooling element 11 is, in a transition portion to the perforated ducting section 8, provided with a rotatable is damper 14. By that means, the ducting section 5, which is normally intended for supply of cooled primary air from the cooling element 11, may be connected to the upper ducting section 9 that leads to the outlet nozzle 10 near the opening 1. In this manner, the cooling element 11 may, as shown in FIG. 2, be defrosted by circulating less cooled air in selected ducting sections 3, 4, 5, 9, 10 of the ducting arrangement when the damper 14 is rotated to a position in which it closes off the perforated ducting section 8, and the cooling element 11 is not active.

The fan 17 in the lower ducting section 4 will, when the cooling element is completely free of ice formations, drive a slightly larger quantity of air in the ducting arrangement than the fan 16 in the upper ducting section 9. As long as the cooling element 11 is relatively free of ice and frost, the temperature difference between cooled air from the cooling element 11, which is carried in between the refrigerated goods 2, and less cooled air, which forms the screening layer, will be in the range 2–5° C. With more frost and ice on the cooling element 11, the air flow from the fan 17 in the lower ducting section 4 will decrease. With this, the fan 16 in the upper ducting section 9 will draw secondary air from the screening layer, mixed with some indoor air, into the shelved cupboard and cause a noticeable increase in the temperature difference. This effect is a new method of providing demand-driven defrosting of the cooling element 11.

The defrosting may be initiated automatically as a result of the increasing temperature of the air in the perforated ducting section 8 as more secondary air from the screening layer is drawn in through the perforated ducting section 8 when the air flow from the fan 17 in the lower ducting is section 4 decreases. The automatic controls (not shown) of the shelved cupboard can thereby arrange for the damper 14 to be turned to the position in which it closes off the perforated ducting section 8, while simultaneously deactivating and possibly heating the cooling element 11 by means of a heating element (not shown). Closing off the perforated ducting section 8 further causes both fans 16, 17 within the shelved cupboard to be connected directly in series, so as to increase the circulation rate past the cooling element 11 and give more rapid defrosting. Also, due to the pressure conditions, the mixture of initially cooled air and any drawn-in indoor air that circulates during the defrosting will not get in between the refrigerated goods 2. Moreover, the speed of the fan 15 that creates the layer of indoor air outside the opening 1 will be increased in order to maintain the laminar flows past the opening 1. Thus the screening effect of the two layers flowing past the opening 1 will effectively prevent the refrigerated goods 2 from being exposed to unwanted entry of any significant amount of indoor air.

It is apparent from FIG. 3 that fluid communication has been established between the internal cavities 6, 7 of the shelves 12 and the primary air duct 5 (105 in FIGS. 4 and 5) through connecting ports 8' (108' in FIGS. 4 and 5) that extend through vertical boundary/dividing walls for the perforated duct 8.

Figure 4:
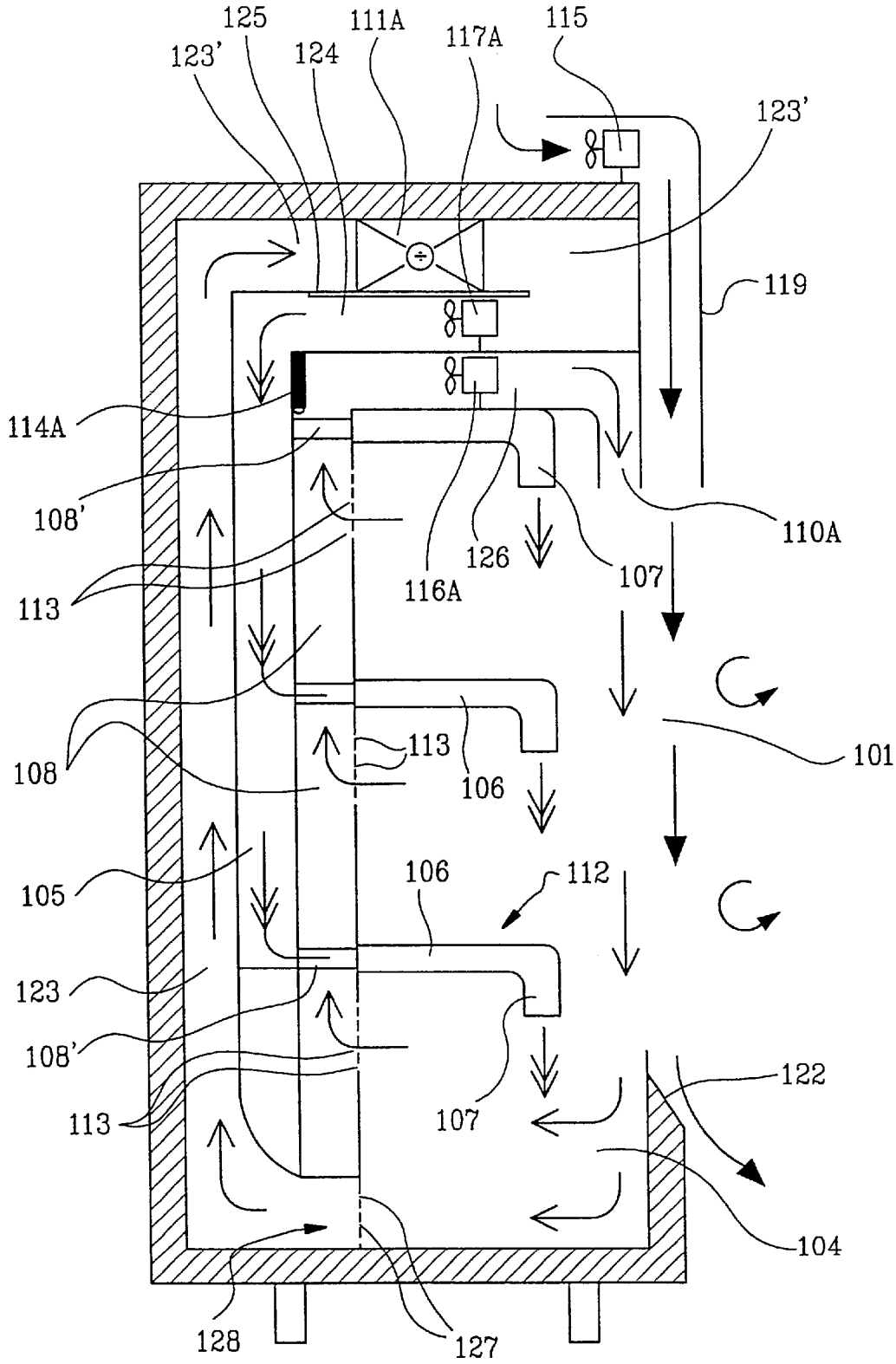
FIG. 4 shows a second embodiment of a shelved cupboard according to the invention, in which the cooling element is placed in the upper part of the internal cavity of the shelved cupboard, and where the air circulations and air flows follow paths and flow patterns corresponding to the normal operating state of the shelved cupboard.
Figure 5:
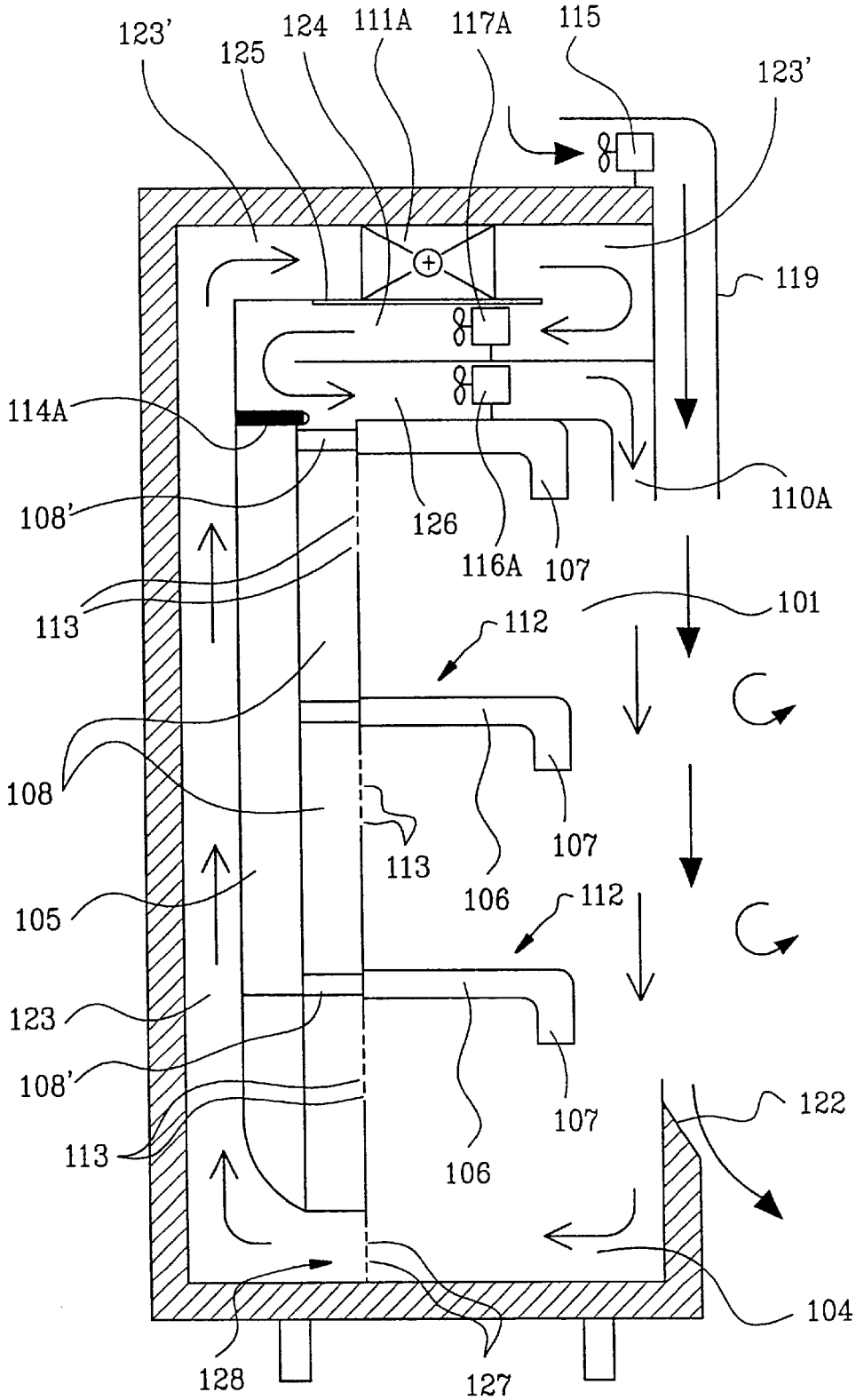
FIG. 5 shows the same embodiment as FIG. 4, but where a rotatable damper is set so as to leave the ducting system of the shelved cupboard in a defrosting mode w.r.t. the cooling element.

In its broad features, the embodiment shown in FIGS. 4 and 5 of a shelved cupboard according to the present invention exhibits the same constructional design as the shelved cupboard structure of FIGS. 1 to 3.

Thus the shelved cupboard of FIGS. 4 and 5 has an uncovered opening 101, a back wall, a roof wall and two opposite side walls, as well as internal dividing walls that define a ducting system adapted to circulation of primary and secondary air.

In the shelved cupboard shown in FIGS. 4 and 5, the cooling element/battery 111A is positioned on a drip tray 125 inside a horizontal ducting section 123' in the upper part, as opposed to the cooling element/battery 11 of FIGS. 1 to 3, arranged in the lower part of the internal cavity of the shelved cupboard. In ducting section 123', secondary air coming from the screening layer inside the opening 101 passes into and through the cooling element 111A to be cooled, in order to create primary air (directional arrows with double arrowheads) that via a fan 117A is caused to flow from the portion of the horizontal ducting section 123' most proximal to the opening 101 and further in an underlying horizontal ducting section 124 to a vertical primary air duct 105.

The primary air duct 105 may by means of a rotatable damper 114A be put out of action during the defrosting mode of the shelved cupboard, see FIG. 5.

From the primary air duct 105, which is closed at its lower end, the primary air flows via ports 108' (corresponding to the ports 8' of FIGS. 1 to 3) and into the hollow cupboard shelves 112 having outlet nozzles 107 located nearest the opening 101 for somewhat less cold air, termed secondary air, which on flowing out of the outlet nozzles 107 has absorbed heat from shelves and refrigerated goods, thereby cooling these. As is apparent from FIG. 3, the ports 108' are formed by pieces of piping extending in a sealing manner through the dividing walls that define a vertical ducting section 108 with perforations 113 in a delimiting dividing wall located most proximal to the uncovered cupboard opening 101.

Secondary air flowing out of the outlet nozzles 107 of the shelves 112 is sucked into the last-mentioned vertical ducting section 108 by a fan 116A and carried towards outlet nozzle 110A (corresponding to the nozzle 10 in FIGS. 1 to 3), in order to then be blown out in the downward direction to form said air curtain/screening layer immediately inside the front wall edges of the shelved cupboard defining the uncovered opening 101. The nozzle(s) 107 is/are disposed in an angled, downward facing outlet portion of the shelf body 112; however this could also be directed upwards.

In the lowermost area of the shelved cupboard, secondary air from the screening layer then flows into a rear vertical duct 123 via perforations 127 in a dividing wall 128 between the lower end of the duct 108 and the bottom of the cupboard. This secondary air is caused to flow upward in the duct 123 via the sucking action of the fan 117A, to the upper end of the duct 123, where it passes into said upper horizontal ducting portion 123' wherein the cooling element/battery 111A has been installed as previously indicated, whereupon the process is repeated.

In the defrosting mode, the cooling element/battery 111A is rendered inactive, and the damper 114A is rotated down to a position in which it closes off duct 108 at its upper end.

The circulation of secondary air during defrosting is indicated by arrows, and generally follows the course that formed the basis of the defrosting airflows of the shelved cupboard according to FIGS. 1 to 3.

Figure 6:
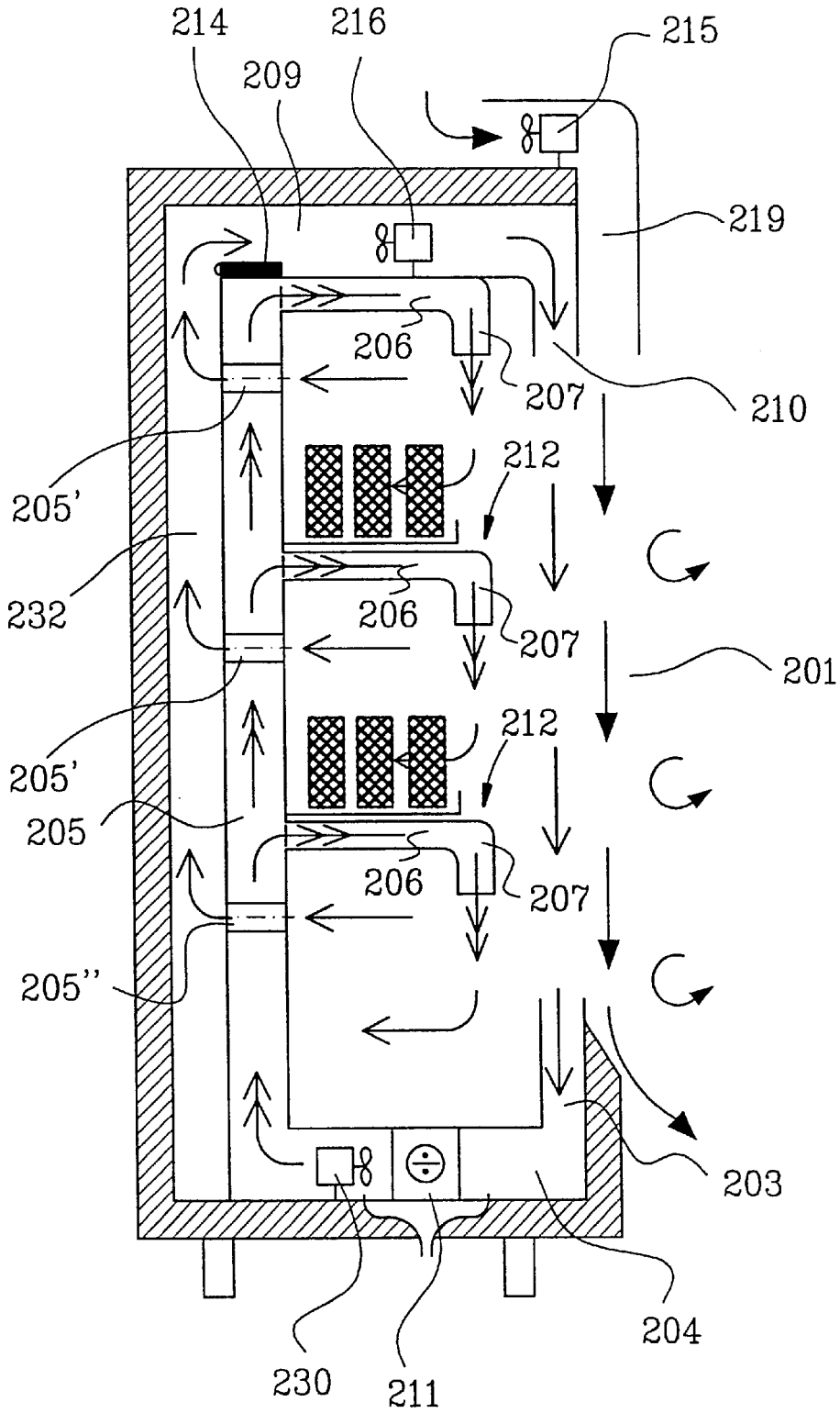
FIG. 6 shows a third embodiment of a shelved cupboard according to the invention.
Figure 7:
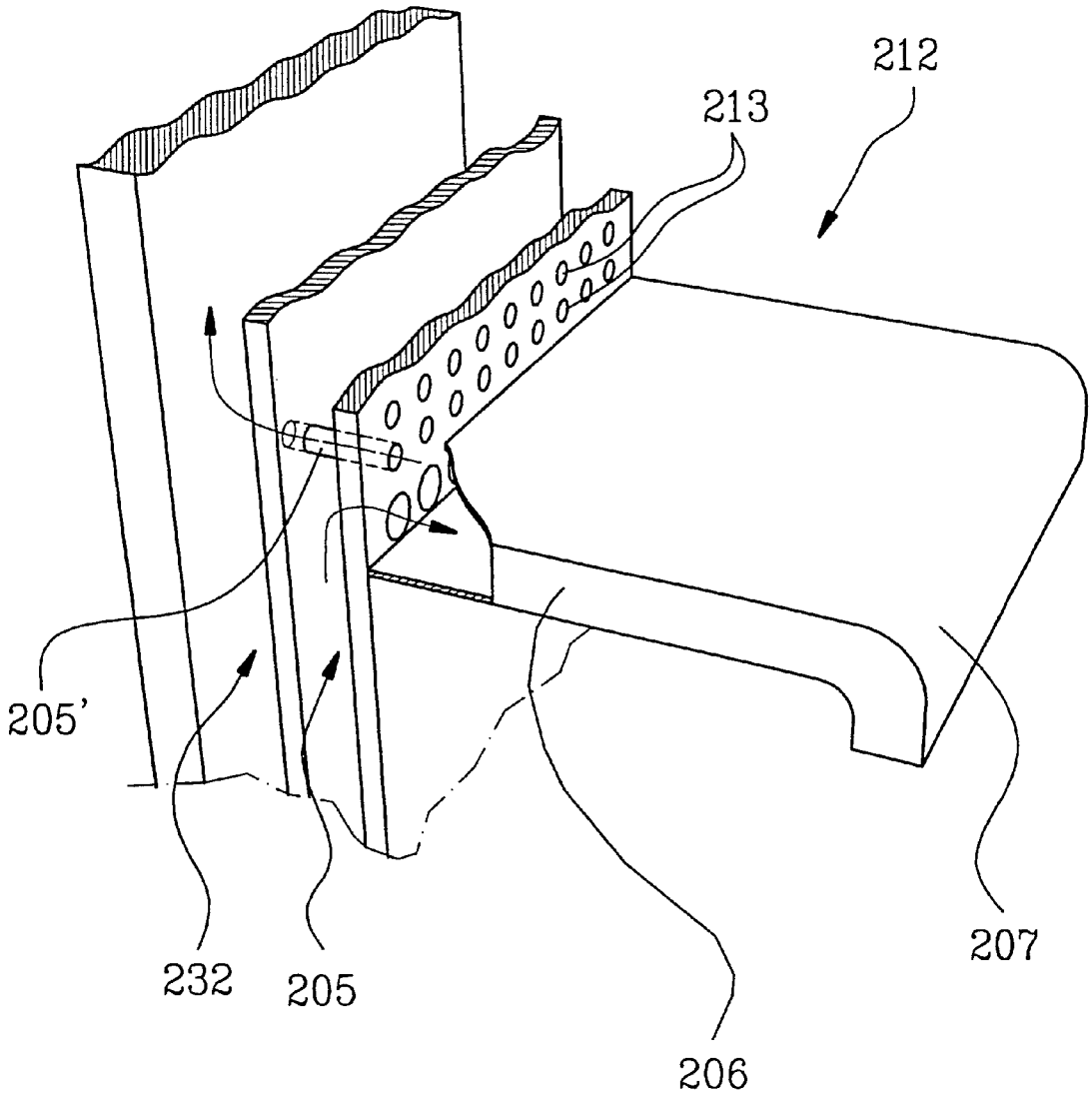
FIG. 7 shows an enlarged perspective view similar to FIG. 3, but associated with the embodiment shown in FIG. 6.

FIGS. 6 and 7 illustrate a third embodiment that in inventive terms is consistent with the two previous.

By the schematic vertical section in FIG. 6, the shelved cupboard is constructed so as to have a structure generally corresponding to that of the other embodiments (FIGS. 1–3 and 4, 5 respectively). A first vertical upward ducting section 205 forms part of the primary air ducting system of the shelved cupboard, and is supplied with cooled air, primary air, from a lower horizontally directed ducting section 204 that holds a cooling element 211 and a downstream fan 230.

Said first, upward ducting section 205 for primary air communicates with through cavities 206, 207 in the hollow cupboard shelves 212.

That part of the interior cavity of the shelved cupboard which lies in front of and between the shelves communicates with a second, rear ducting section 232 (for secondary air) via pipes 205' (only one drawn in FIG. 7) with forward inlet holes 213.

At the top, this rear, vertically directed secondary air ducting section 232 passes into a forward directed, horizontal ducting section 209 associated with fan 216 and damper 214 for setting of the ducting system to operation/defrosting in what is in principle the same manner as for the two above described embodiments.

What is claimed is:

1. A cupboard for storing and refrigerating goods, said cupboard comprising:

an opening, said opening providing access to a storage area wherein the goods are stored;

a primary ducting system directing air cooled by a cooling element into said storage area to refrigerate the goods; and a secondary ducting system connected in series with said primary ducting system, said secondary ducting system collecting air from said storage area, and directing said air across said opening to create an air curtain across said opening.

2. The cupboard according to claim 1, wherein said primary ducting system comprises a lower section and a vertical section disposed along a back wall of said cupboard.

3. The cupboard according to claim 1, further comprising at least one shelf for supporting the goods, said at least one shelf disposed in said storage area.

4. The cupboard according to claim 3, wherein said at least one shelf comprises an air conduit communicating with said primary ducting system and conveying the cooled air from said primary ducting system into said storage area.

5. The cupboard according to claim 4, wherein said at least one shelf further comprises an outlet nozzle, said outlet nozzle disposed at an end of said shelf proximate to said opening in said cupboard.

6. The cupboard according to claim 4, further comprising a plurality of shelves, wherein each shelf comprises a spacer.

7. The cupboard according to claim 1, further comprising a primary air fan disposed in said primary ducting system and effecting air flow through said primary ducting system.

8. The cupboard according to claim 7, wherein said primary air fan is disposed in a lower section of said primary ductwork.

9. The cupboard according to claim 1, wherein said cooling element comprises an evaporation battery.

10. The cupboard according to claim 1, wherein said cooling element is positioned above a drip tray.

11. The cupboard according to claim 1, wherein said secondary ducting system comprises a perforated section through which air from said storage area is collected.

12. The cupboard according to claim 11, wherein said perforated section is disposed along a back wall of said storage area.

13. The cupboard according to claim 1, wherein said secondary ducting system comprises an outlet nozzle for directing air across said opening to form said air curtain.

14. The cupboard according to claim 13, wherein said outlet nozzle is disposed along a top portion of said opening.

15. The cupboard according to claim 1, further comprising a secondary air fan disposed said secondary ducting system, said secondary air fan drawing air from said storage area into said secondary ducting system and forcing air from said secondary ducting system across said opening to form said air curtain.

16. The cupboard according to claim 1, further comprising means for creating a secondary air curtain immediately outside of, and adjacent to, said air curtain from said secondary ducting system.

17. The cupboard according to claim 16, wherein said means comprise a fan disposed in an external ducting section.

18. The cupboard according to claim 1, further comprising a common outlet section uniting said primary ducting system and said secondary ducting system, wherein said primary ducting system and said secondary ducting system are selectably placed in communication with said outlet section by a dampening member.

19. The cupboard according to claim 18, wherein said dampening member comprises a valve that is selectively positionable to alternatively link either said primary ducting system or secondary ducting system to said outlet member.

20. The cupboard according to claim 19, wherein when said primary ducting system is linked to said outlet member, air cooled by said cooling element is directed across said opening to form an air curtain across said opening.

21. The cupboard according to claim 20, wherein when said primary ducting system is linked to said outlet member, a primary air fan and a secondary air fan communicate in series to force air through said primary ducting system and said outlet member and across said opening.

22. A cupboard for storing and refrigerating goods, said cupboard comprising:

an opening, said opening providing access to a storage area wherein the goods are stored;

a primary ducting system directing air cooled by a cooling element into said storage area to refrigerate the goods;

a secondary ducting system connected in series with said primary ducting system, said secondary ducting system collecting air from said storage area and directing the collected air across said opening to create an air curtain across said opening; and a dampening member, said dampening member selectively positionable to close said secondary ducting system and open said primary ducting system, such that air from said primary ducting system bypasses said storage area and is directed across said opening to create said air curtain.

23. A method of controlling circulation of air in a refrigerated cupboard having a storage area accessible through an opening, said method comprising the steps of:

directing air cooled by a cooling element into the storage area to refrigerate goods stored therein; and collecting air in series from that directed into the storage area and redirecting the collected air across said opening to create an air curtain across said opening.

* * * * *